United States Patent [19]

Ferrara, Jr.

[11] 4,077,513

[45] Mar. 7, 1978

[54] LATCHING ARRANGEMENT FOR CONNECTABLE PANELS

[75] Inventor: Daniel A. Ferrara, Jr., New Milford, Conn.

[73] Assignee: Ferrara-Benedek Design, Inc., New York, N.Y.

[21] Appl. No.: 734,055

[22] Filed: Oct. 20, 1976

[51] Int. Cl.[2] ..... B65D 5/64

[52] U.S. Cl. ..... 206/106; 229/43; 229/45 R

[58] Field of Search ..... 229/40, 43, 45; 206/96, 206/104, 106, 171–173

[56] References Cited

U.S. PATENT DOCUMENTS

| | | | |
|---|---|---|---|
| 1,963,378 | 6/1934 | Peiter | 229/45 |
| 2,310,499 | 2/1943 | Vineberg | 229/40 |
| 2,331,754 | 10/1943 | Wohlers | 229/45 |
| 3,972,416 | 8/1976 | Underwood | 206/106 |

*Primary Examiner*—George E. Lowrance
*Assistant Examiner*—Douglas B. Farrow
*Attorney, Agent, or Firm*—Blum, Moscovitz, Friedman & Kaplan

[57] ABSTRACT

A latching arrangement for connectable panels which prevents accidental separation of latched panels and which requires manual dexterity to unlatch them. Interengaging tongues and slots provides a connection which is secure against young children.

7 Claims, 8 Drawing Figures

FIG. 1
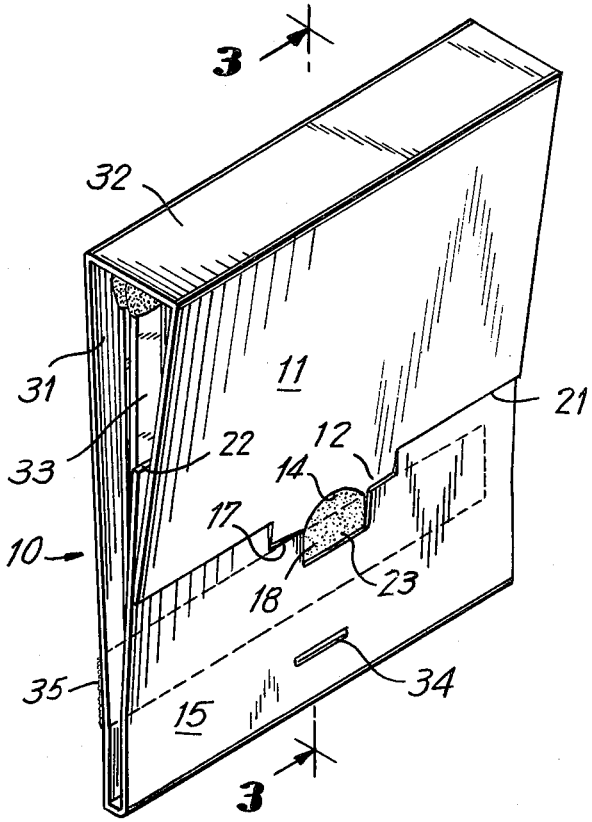
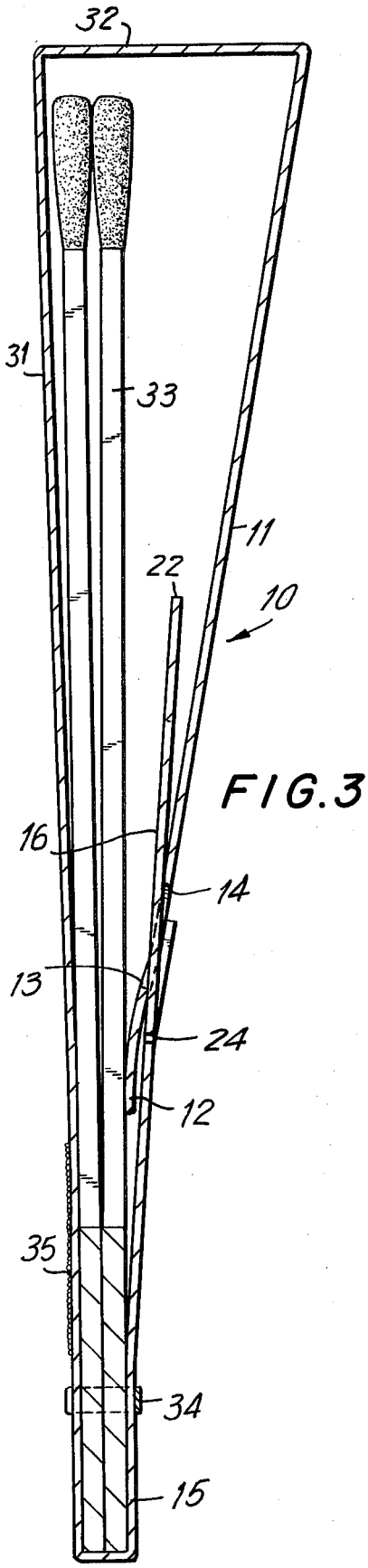
FIG. 3
FIG. 2
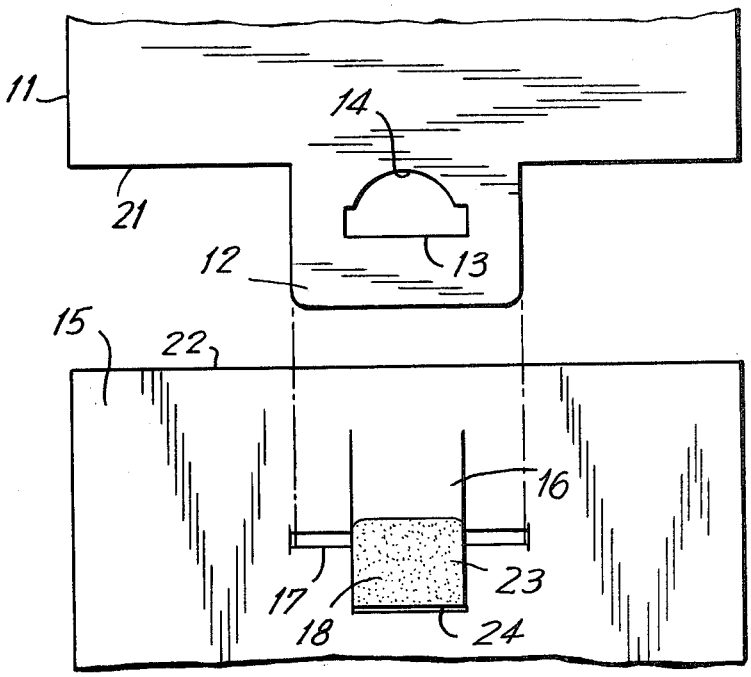

LATCHING ARRANGEMENT FOR CONNECTABLE PANELS

BACKGROUND OF THE INVENTION

This invention relates generally to a latching arrangement for connectable panels. Prior latching arrangements have generally been extremely simple to operate and thereby offered little protection against unauthorized separation, such as by children. Such arrangements did not provide a secure latch which would not accidentally separate. Where the latching arrangements were more complex, such arrangements were relatively expensive and difficult to manufacture.

SUMMARY OF THE INVENTION

Generally speaking, in accordance with the invention, an inexpensively manufactured latching arrangement for connectable panels is provided. Such arrangement requires manual dexterity to disconnect the panels and is resistant to accidental separation and is therefore especially suitable for match books to provide safety against use by children. The latching arrangement has a first panel with an extending tongue, with a lateral slot therein. A second panel has a longitudinally oriented U-shaped tongue and a transverse slot. The extending tongue of the first panel fits into the transverse slot of the second panel, and the second panel U-shaped tongue is insertable into the lateral slot of the first panel when the first panel is moved in one longitudinal direction relative to the second panel. The second panel tongue prevents separation of the panels when it is physically prevented from entering the first panel slot.

Accordingly, it is an object of this invention to provide an improved latching arrangement for connectable panels which requires manual dexterity for disconnection.

Another object of this invention is to provide an improved latching arrangement for connectable panels which is resistant to accidental unlatching.

A further object of this invention is to provide an improved latching arrangement for connectable panels which is inexpensive to manufacture.

Still another object of the invention is to provide an improved latching arrangement for the connectable panels of a match book which substantially obstructs opening by young children.

Still other objects and advantages of the invention will in part be obvious and will in part be apparent from the specification and drawings.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of a match book embodying connectable panels in a latched position.

FIG. 2 is a partial elevational view of the connectable panels in a separated position.

FIG. 3 is a sectional view taken along line 3—3 of FIG. 1.

DESCRIPTION OF THE PREFERRED EMBODIMENT

Figure 4:
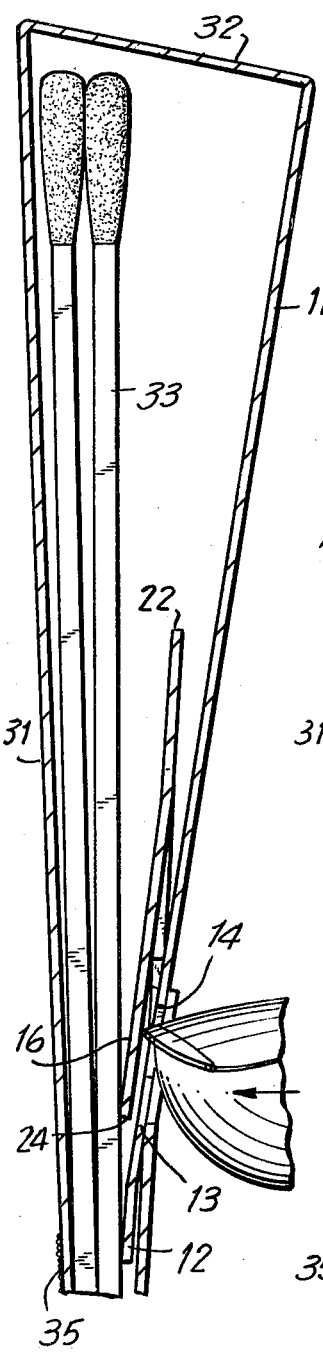
FIG. 4 is a view similar to FIG. 3 showing manual operation for the first step in unlatching the connectable panels.

Referring now to FIG. 1—3, which show the latching arrangements for connectable panels embodied in a matchbook 10, it should be understood that the latching arrangement is not limited to matchbooks, but rather, is applicable wherever a latching arrangement for connectable panels is useful.

A first panel 11 forms the upper moveable cover of the matchbook and has a tongue 12 extended from its leading edge 21. The tongue portion 12 has a lateral slot 13 cut therein. For a purpose to be hereafter described, lateral slot 13 is provided with a curved enlargement 14.

A second panel 15 forms the lower front cover of matchbook 10. Second panel 15 is provided with a longitudinally oriented, generally U-shaped tongue 16 formed in panel 15 proximate to an edge 22 of second panel 15. Tongue 16 extends longitudinally away from edge 22. Second panel 15 further includes a transverse slot 17 which spans tongue 16. In other words, slot 17 is located intermediate the longitudinal extend of tongue 16. The lower portion 18 of tongue 16 may be provided with visual indicia 23 (such as applying to the lower portion 18 an ink color contrasting with the color of the rest of second panel 15) in order to visually indicate the location of U-shaped tongue 16 which facilitates opening of the latched panels as will hereafter be described.

Transverse slot 17 is constructed to facilitate the insertion of tongue portion 12 of first panel 11 thereunto. That is, the length of transverse slot 17 is greater than the width of tongue portion 12, and the width of transverse slot 17 is greater than the thickness of the material used to construct tongue portion 12. Similarly, lateral slot 13 is constructed to receive U-shaped tongue 16. Accordingly, the length of lateral slot 13 is greater than the width of U-shaped tongue 16 and the width of lateral slot 13 is greater than the thickness of the material used to construct U-shaped tongue 16. Lateral slot 13 is located so that when extended tongue 12 is inserted into transverse slot 17, slot 13 is moveable to a point such that the lower edge of slot 13 is beyond the terminal edge 24 of U-shaped tongue 16.

In order to latch the panels, first panel 11 is brought into overlying relationship with second panel 15 and tongue portion 12 is inserted into transverse slot 17. This initially inwardly deflects tongue 16 behind tongue 12. When slot 13 passes terminal edge 24, the resiliency of tongue 16 causes it to move outwardly whereupon terminal edge 24 enters slot 13 as may be seen in FIG. 3. A closed and latched matchbook is illustrated in FIG. 1.

Figure 5:
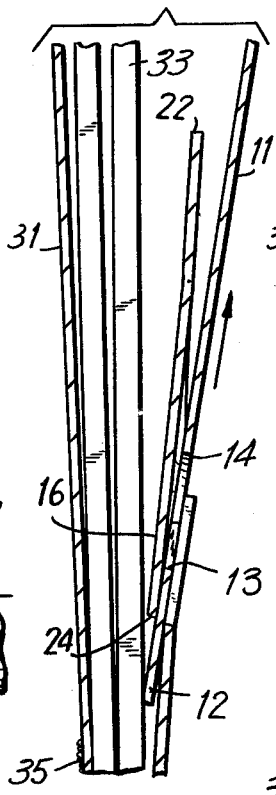
FIG. 5 is a partial view similar to FIG. 4 showing the second step of unlatching the connectable panels.
Figure 6:
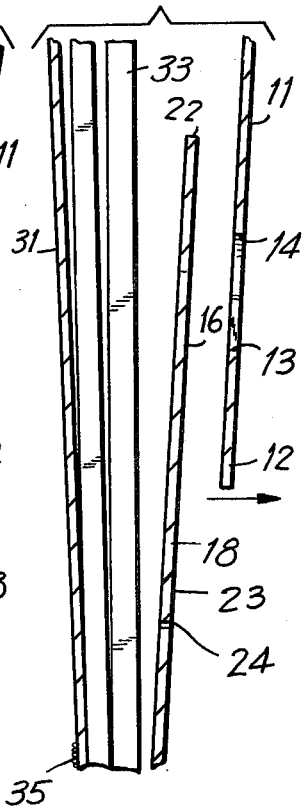
FIG. 6 is a partial view similar to FIG. 4 showing the panels after they have been unlatched.

The FIGS. 4–6 illustrate the steps required to open the latched panels. First panel 11 is moved downward to increase its overlying relationship with panel 15 so that the lower edge of the lateral slot 13 is beyond the terminal edge 4 of U-shaped tongue 16. First panel 11 is then in the FIG. 4 position. The user's finger is inserted through enlargement 14 of lateral slot 13 and U-shaped tongue 16 is contacted and depressed. First panel 11 is then moved upward as shown in FIG. 5. After extended tongue portion 12 is removed from transverse slot 17 the cover panel may be opened as shown in FIG. 6.

Figure 7:
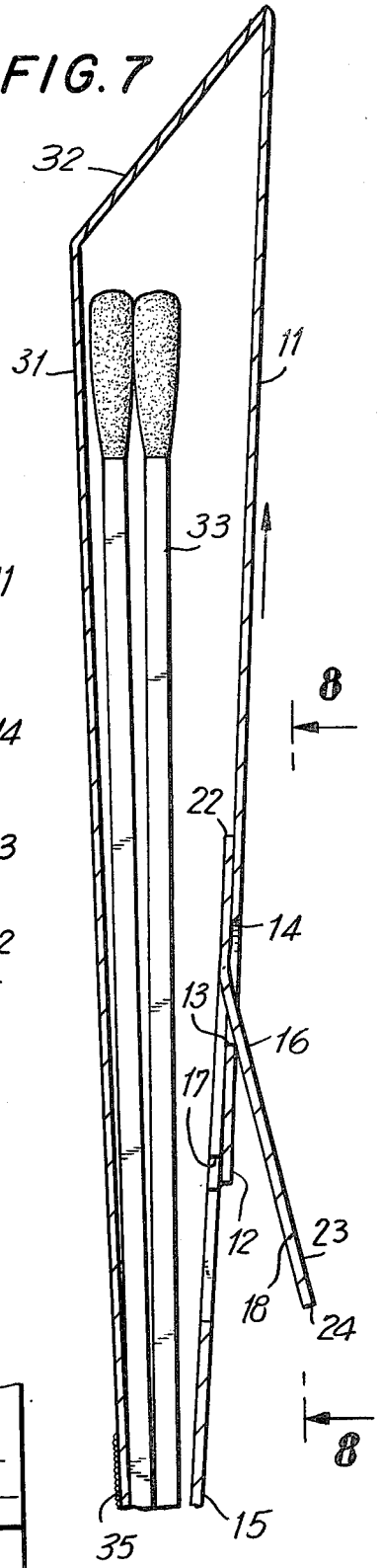
FIG. 7 is a view similar to FIG. 3 of the connectable panels when an improper opening procedure has been followed.
Figure 8:
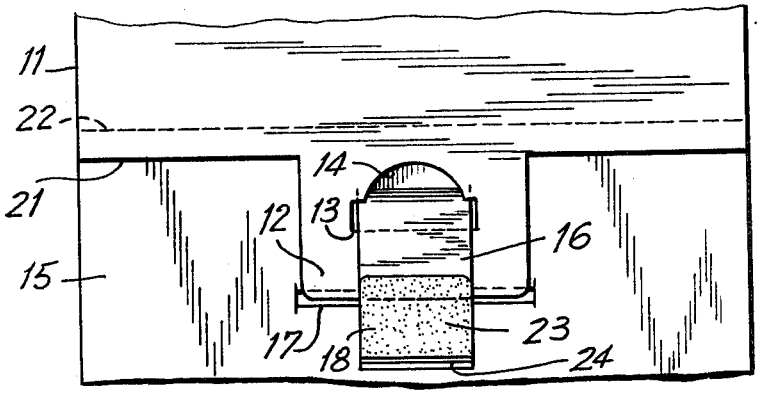
FIG. 8 is a partial elevational view of the panels in the FIG. 5 position.

FIGS. 7 and 8 illustrate the results of an improper opening procedure. When U-shaped tongue 16 is not depressed by the insertion of a finger through enlargement 14 of lateral slot 13, the U-shaped tongue will pass through slot 13 when first panel 11 is moved upwardly. U-shaped tongue 16 will be pulled outwardly by the movement of first panel 11, as shown in FIG. 7. When slot 13 reaches the point where tongue 16 joins panel 15, further movement of first panel 11 will be prevented, as shown in FIG. 8. This condition will also occur if the upper panel is subjected to accidental movement. Note that tongue 16 must have a minimum degree of resiliency to bias it toward coplanar relationship with panel 15 so that it will enter into slot 13 when panel separation is attempted without depression of tongue 16.

As aforenoted, a typical use of the present invention is in association with a matchbook to prevent opening by small children. A typical matchbook construction is depicted in the drawing. The book consists of first panel 11, second panel 15, a rear panel 31 and a top panel 32, all of which may be formed of a single sheet of paperboard or other suitable material. Position within the "book" is a set of matches 33 and the usual staple fastener 34 is used for assembling the matchbook. A striker layer 35 may be applied to rear panel 31.

From the foregoing it should be evident that a certain degree of manual dexterity is required to separate the panels but they are easily connected by merely inserting tongue 12 into slot 17 and fully advancing the first panel 11 over second panel 15. A mere pull on the panels will result in the obstructed condition of FIG. 7. Opening or separating requires a three step operation. First, the first panel must be fully advanced over the second panel. Second, the portion 18 of tongue 16 exposed through enlargement 14 must be manually depressed. Thus, while holding tongue 16 in the depressed mode, the first and second panels must be slidingly retracted from one another.

It will thus be seen that the objects set forth above, among those made apparent from the proceeding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A latching arrangement for connectable panels comprising first and second panels, said first panel adapted to overlie a portion of said second panel in a latched position, said first panel having a leading edge and a first tongue extending therefrom beyond said leading edge, said first tongue including a first slot therein having a transversely extending longitudinal axis and a width, said second panel having an edge positioned beneath said first panel when said first panel is in overlying relationship with respect to said second panel and including a second tongue and a second slot, said second tongue being located wholly within said second panel and having a longitudinal extent directed away from said edge of said second panel, said second slot having a transversely extending longitudinal axis and a width, said transversely extending longitudinal axis of said second slot being generally perpendicular to the longitudinal extent of said second tongue, and said second slot spanning said second tongue and being positioned in said second panel wholly within the longitudinal extent of said second tongue.

2. A latching arrangement for connectable panels as claimed in claim 1 wherein the length of said second slot is greater than the width of said first tongue, the width of said second slot is greater than the thickness of said first tongue, the length of said first slot is greater than the width of said second tongue and the width of said first slot is greater than the thickness of said second tongue.

3. A latching arrangement for connectable panels as claimed in claim 1 wherein said first slot includes an enlargement portion located intermediate the terminus of said first slot and said leading edge of said first panel thereby defining a first slot whose major width is substantially greater than the thickness of said second tongue.

4. A latching arrangement for connectable panels as claimed in claim 1 wherein the longitudinal distance between said first slot and said leading edge of said first panel is at least as great as the longitudinal distance between said second slot and the terminal edge of said second tongue.

5. A latching arrangement for connectable panels as claimed in claim 1 wherein at least said second panel is formed of a material having inherent resiliency whereby, upon insertion of said first tongue in said second slot, said second tongue will be capable of being deflected and returning to its original position substantially coplanar with said second panel.

6. A latching arrangement for connectable panels as claimed in claim 1 wherein at least a portion of the surface of said second tongue has applied thereto indicia which contrasts said portion with a surrounding portion of said second panel.

7. A latching arrangement for connectable panels as claimed in claim 1, wherein said first panel forms the movable cover of a book of matches and the second panel forms a fixed cover secured to the book of matches.

* * * * *